United States Patent [19]

Willis

[11] Patent Number: 5,036,927

[45] Date of Patent: Aug. 6, 1991

[54] APPARATUS FOR GRIPPING A DOWN HOLE TUBULAR FOR ROTATION

[75] Inventor: Clyde A. Willis, Wichita Falls, Tex.

[73] Assignee: W-N Apache Corporation, Wichita Falls, Tex.

[21] Appl. No.: 587,170

[22] Filed: Sep. 19, 1990

Related U.S. Application Data

[63] Continuation of Ser. No. 321,894, Mar. 10, 1989, abandoned.

[51] Int. Cl.[5] ..... E21B 3/02; E21B 19/16

[52] U.S. Cl. ..... 175/162; 166/77.5; 166/78; 173/164; 175/170

[58] Field of Search ..... 175/113, 162, 170, 171, 175/202, 203, 220; 166/78, 77.5, 85; 173/164, 56; 81/57.18, 57.17, 57.21; 294/86.25, 86.3

[56] References Cited

U.S. PATENT DOCUMENTS

| | | | |
|---|---|---|---|
| 1,200,612 | 10/1916 | Helm . | |
| 1,292,747 | 12/1919 | Foster . | |
| 1,687,808 | 5/1927 | Thomas et al. . | |
| 1,740,377 | 5/1928 | Snyder et al. . | |
| 1,843,537 | 2/1932 | Bickerstaff . | |
| 1,981,656 | 12/1931 | Masters et al. . | |
| 2,016,652 | 12/1932 | Poole . | |
| 2,181,641 | 8/1938 | Hicks . | |
| 3,129,013 | 5/1960 | Thompson et al. | 279/109 |
| 3,278,220 | 1/1965 | Wilson | 294/86.25 |
| 3,371,562 | 10/1965 | Kelley | 81/54 |
| 3,550,485 | 5/1969 | Dickmann | 81/57.15 |
| 3,610,640 | 10/1971 | Bollin et al. | 279/1 SG |
| 3,623,558 | 11/1971 | Brown | 175/171 X |
| 3,722,603 | 3/1973 | Brown | 173/164 X |
| 3,722,607 | 3/1973 | Ray | 173/164 X |
| 3,734,212 | 5/1973 | Perlewitz | 175/171 |
| 3,747,675 | 7/1973 | Brown | 166/237 |
| 3,766,991 | 10/1973 | Brown | 173/20 |
| 3,776,320 | 12/1973 | Brown | 173/163 |
| 3,793,913 | 2/1974 | Wilms | 81/57.18 |
| 3,915,244 | 10/1975 | Brown | 166/77.5 X |
| 4,291,598 | 9/1981 | Cherry | 81/57.15 |
| 4,357,843 | 11/1982 | Peck et al. | 81/57.16 |
| 4,386,544 | 6/1983 | Fuminier | 82/101 |
| 4,511,169 | 4/1985 | Willis | 294/116 |
| 4,522,439 | 6/1985 | Haney | 294/110.1 |
| 4,570,706 | 2/1986 | Pugner | 166/77.5 |
| 4,576,254 | 3/1986 | Cox | 188/67 |
| 4,589,503 | 5/1986 | Johnson et al. | 175/113 |
| 4,650,236 | 3/1987 | Haney et al. | 294/110.1 |
| 4,660,634 | 4/1987 | Johnson, Jr. | 166/77.5 |
| 4,667,752 | 5/1987 | Berry et al. | 175/85 |
| 4,709,604 | 12/1987 | Rogers | 82/4 C |
| 4,711,310 | 12/1987 | Luen | 175/171 |
| 4,762,187 | 8/1988 | Haney | 175/171 |
| 4,821,814 | 4/1989 | Willis et al. | 173/164 |
| 4,867,236 | 9/1989 | Haney et al. | 166/77.5 |

FOREIGN PATENT DOCUMENTS 2706940 8/1978 Fed. Rep. of Germany .

OTHER PUBLICATIONS

Weatherford Oilfield Power Equipment, pp. 12 and 13.

*Primary Examiner*—Hoang C. Dang

*Attorney, Agent, or Firm*—Willian Brinks Olds Hofer Gilson & Lione

[57] ABSTRACT

An apparatus for gripping a down hole tubular for rotation in a drilling machine includes a support member adapted for connection to the quill of the drilling machine. The support member supports three or more guides which converge toward one another in a selected direction. A clamping dog or engaging member is mounted to slide in each of the guides to move into engagement with a down hole tubular when positioned toward a first end of the guide and out of engagement with the down hole tubular when positioned toward a second end of the guide. A linkage interconnects the engaging members, and includes an acutating member exposed at an upper portion of the support member. This actuating member moves vertically along an axis between open and closed positions, which causes the engaging members to release or engage the tubular. The actuating member itself bears against an additional element on the top head drive assembly of the drilling machine which can be moved vertically to cause the clamping dogs to engage or release the tubular.

15 Claims, 3 Drawing Sheets

FIG. 2
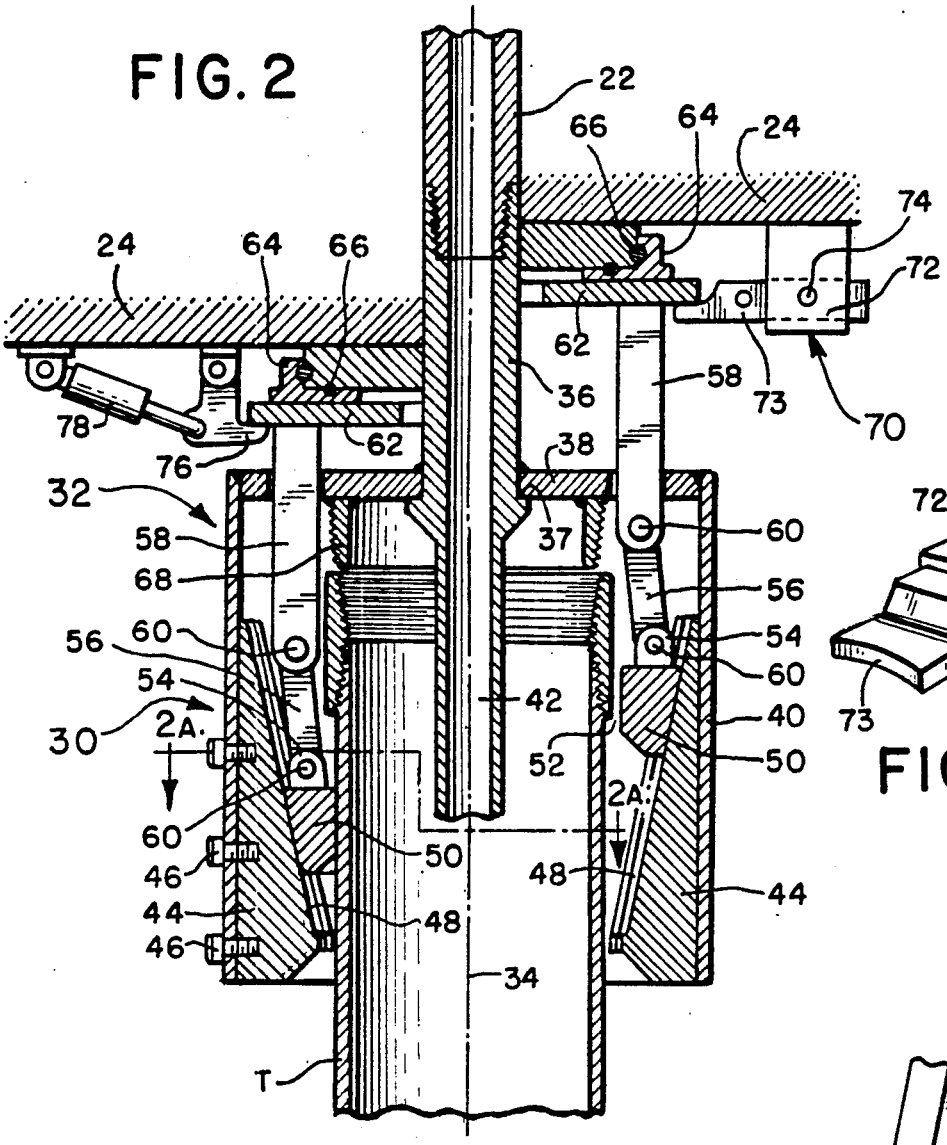
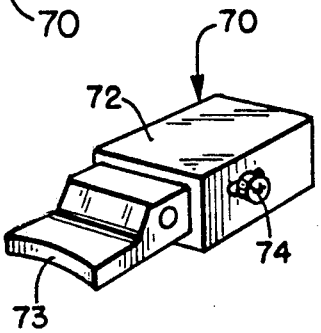
FIG. 2c
FIG. 2A
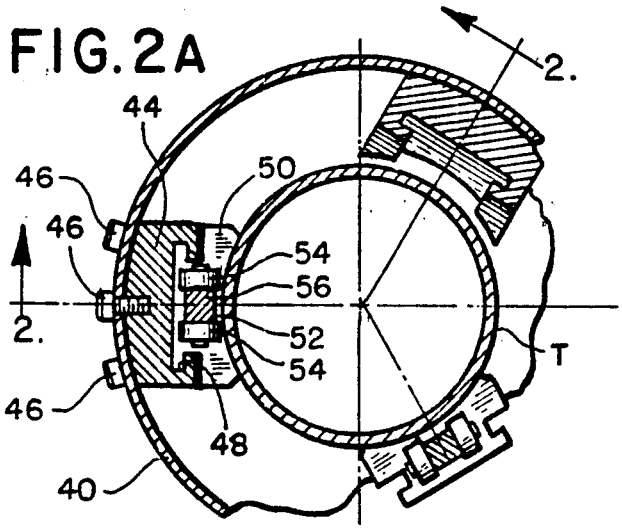
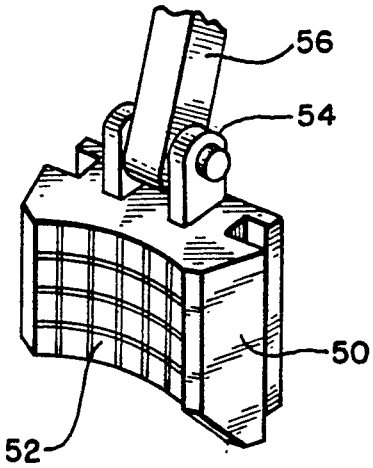
FIG. 2B

APPARATUS FOR GRIPPING A DOWN HOLE TUBULAR FOR ROTATION

This application is a continuation of application Ser. No. 07/321,894, filed Mar. 10, 1989 now abandoned.

BACKGROUND OF THE INVENTION

This invention relates to an improved apparatus for gripping a down hole tubular for rotation that it is suitable for use in a drilling machine, such as an oil well drilling machine, and that operates simply and reliably, with a minimum of parts.

It has been recognized for some time that there is a need for tools to engage down hole tubulars such as drill pipes and casings in a high speed manner for rotation in a drilling machine. Depending upon the size of the down hole tubular the apparatus can be designed either to fit around the upper end of the tubular as described in U.S. patent application Ser. No. 07/107,268 (parent application of U.S. Pat. No. 4,867,236) now abandoned, assigned to the assignee of the present invention. Alternately, the engaging apparatus can be designed to fit into the upper end of the down hole tubular and to grip the tubular from within, as described in U.S. Pat. No. 4,762,187, also assigned to the assignee of the present invention.

Both of these devices utilize friction brakes to move the clamping jaws into and out of engagement with the down hole tubular. Though this approach has been found effective and reliable, it is not without disadvantages. In particular, the braking mechanisms result in relatively complex linkages with a relatively large number of parts. There can be a concern among some users that parts may become disengaged from the mechanism and fall into the borehole, thereby creating significant problems. Also, in some applications the device itself moves axially with respect to the remaining portions of the drilling machine. Such axial movement may complicate the braking mechanism used to engage and disengage the clamping elements from the down hole tubular.

The present invention is directed to improved devices for engaging a down hole tubular for rotation, which to a large extent overcome the disadvantages discussed above by completely eliminating the need for a friction brake system.

SUMMARY OF THE INVENTION

According to this invention, an apparatus is provided for engaging a down hole tubular for rotation in a drilling machine of the type comprising a rotatable quill, means for rotating the quill, means for vertically positioning the quill, and means for vertically moving an additional element beneath the rotating means with respect to the quill. The tubular engaging apparatus of this invention comprises a support member adapted for connection to the quill. A plurality of guides are mounted on the support member around an axis defined by the support member, and these guides are disposed at an angle with respect to the axis. A plurality of engaging members are each mounted to move in a respective one of the guides to move into engagement with a down hole tubular when positioned toward a first end of the respective guide and to move out of engagement with a down hole tubular when positioned toward a second end of the respective guide. The engaging members are adapted to transmit torque from the guides to the engaged down hole tubular. A linkage is coupled to the engaging members and comprises an actuating member exposed at an upper portion of the support member and adapted for movement along the axis between a closed position in which the linkage urges the engaging members toward the first ends of the guides, and an open position, in which the linkage urges the engaging members toward the second ends of the guides. This actuating member is adapted to bear against the additional element of the drilling machine, such that vertical movement of the additional element with respect to the quill moves the actuating member along the axis and therefore the engaging elements along the guides.

As pointed out below, the tubular engaging apparatus of this invention can be configured to engage the upper end of the tubular at either the internal or external surface of the tubular. Furthermore, the apparatus of this invention provides an extremely simple, reliable and rugged system which minimizes the number of parts and therefore the possibility that parts may become disengaged.

The invention itself, together with further objects and attendant advantages, will best be understood by reference to the following detailed description, taken in conjunction with the accompanying drawings.

BRIEF DESCRIPTION OF THE DRAWINGS

FIG. 2 is a longitudinal sectional view of the embodiment of FIG 1.

FIG. 2*a* is a cross-sectional view taken along line 2*a*—2*a* of FIG. 2.

FIG. 2*b* is a perspective view of one of the engaging members included in the embodiment of FIG. 2.

FIG. 2*c* is a perspective view of a latching member included in the embodiment of FIG. 2.

DETAILED DESCRIPTION OF THE PRESENTLY PREFERRED EMBODIMENTS

Figure 1:
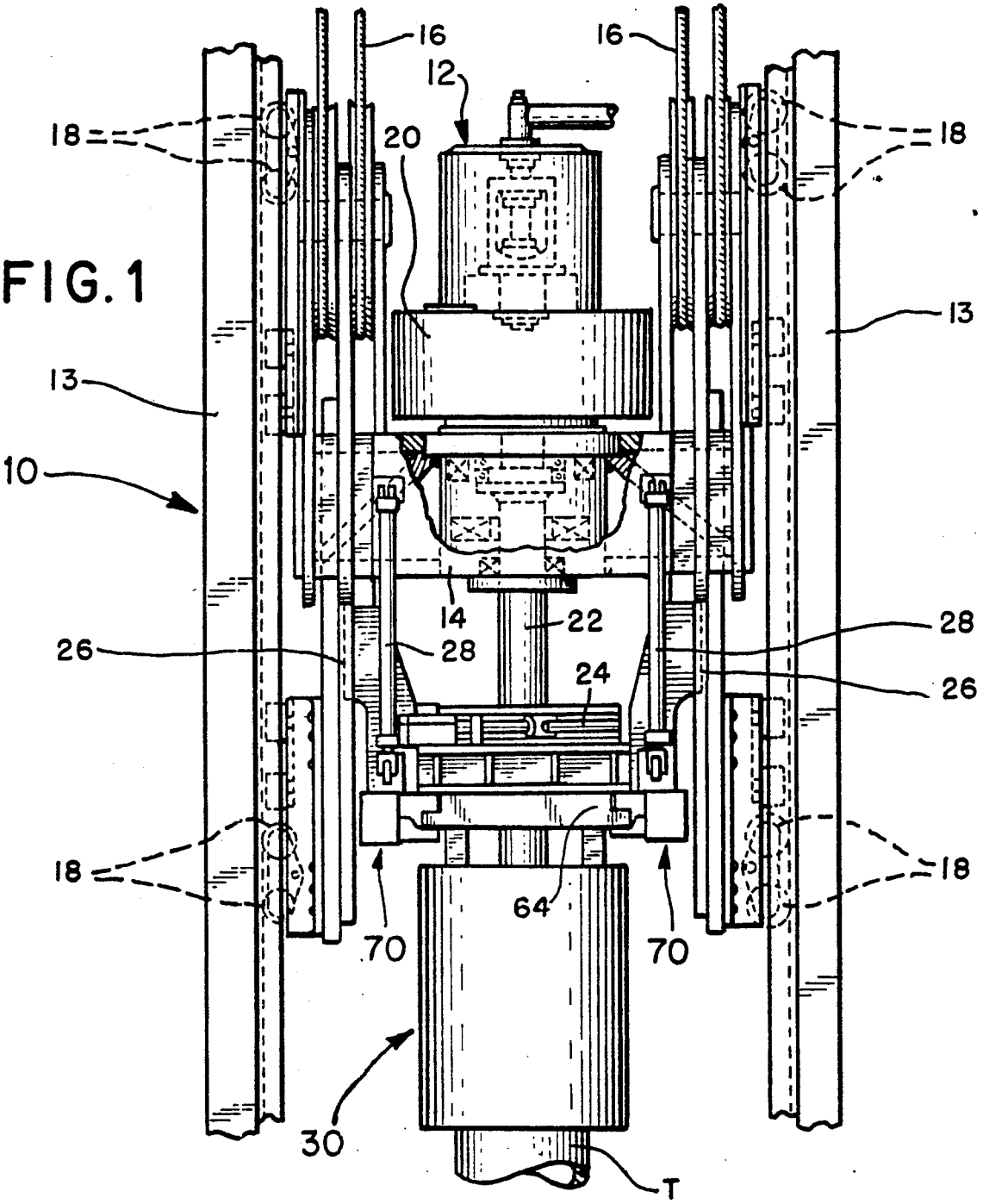
FIG. 1 is an elevational view of a portion of an earth drilling machine to which is mounted a first preferred embodiment of the tubular engaging apparatus of this invention.

Turning now to the drawings, FIG. 1 shows portions of an earth drilling machine 10 which includes a top head drive assembly 12 that moves along a mast 13. The top head assembly 12 includes a main load beam 14 which is suspended from cables 16. The load beam 14 is attached to side frames that include guide wheels 18 that guide the top head drive assembly 12 for vertical movement along the mast 13. A rotating means 20 is mounted on top of the load beam 14, and serves to rotate a quill 22. The rotating means 20 can for example include hydraulic or electric motors and the quill 22 can be coupled to down hole tubular, such as drill pipes or casing. A wrench assembly 24 is mounted beneath the load beam 14 so as to move vertically on guides 26 suspended from the load beam 14. Two or more hydraulic cylinders 28 are interposed between the wrench assembly 24 and the load beam 14 to control the vertical position of the wrench assembly 24. The wrench assembly 24 includes two vertically off-set wrenches which can be rotated with respect to one another in order to make-up and break-out threaded connections.

The features of the drilling machine 10 described above do not per se form part of this invention and are described in order to clarify the environment in which this invention can be used. Further details of the drilling machine 10 are set out in detail in U.S. patent application Ser. No. 07/035,021, now U.S. Pat. No. 4,821,814 assigned to the assignee of the present invention.

According to this invention, a tubular engaging apparatus 30 is mounted to the quill 22 beneath the wrench assembly 24 to engage a down hole tubular T for rotation in either direction as described below. FIGS. 2 through 2*c* relate to a first preferred embodiment 30 of this invention and FIGS. 3 and 3*a* relate to a second preferred embodiment 130.

Turning down to FIGS. 2*a* through 2*c*, the tubular engaging apparatus 30 includes a support member 32 adapted for threaded connection to the quill 22. This support member 32 defines a central longitudinal axis 34, and it includes a stem 36, a flange 38 and body 40 that are welded together to form a single rigid unit. The stem 36 defines an upwardly facing shoulder 37 that supports the flange 38, and a passageway 42 extends completely through the stem 36 and serves to interconnect the central passageway of the quill 22 with the interior of the tubular T that is engaged in the apparatus 30.

The body 40 supports three axially oriented guides 44, each of which converges downwardly toward the axis 34. Each of the guides 44 is mounted fixedly in place to the body 40 by fasteners 46 and defines a T-shaped slot 48. A clamping dog or engaging member 50 is mounted to slide in each of the T-shaped slots 48. Each of the clamping dogs 50 includes a toothed cylindrical face 52, as best shown in FIG. 2*b*, which is shaped and configured to grip the exterior surface of the tubular T for rotation. The upper portion of each of the engaging members 50 defines a pair of ears 54. A lower link 56 extends between the ears 54 and an upper link 58 and the ears 54 and links 56, 58 are connected together by respective pivots 60. The upper ends of the upper links 58 are fixedly mounted, as for example by welding, to an annular actuating member 62 that extends parallel to the flange 38 around the stem 36.

When mounted in place on the drilling machine 10, the actuating member 62 bears on a bearing element 64 that is mounted to the underside of the wrench assembly 24 by means of a thrust bearing 66.

Also mounted to the underside of the wrench assembly 24 is a latch assembly 70 that includes a sleeve 72 and a latch member 73. The sleeve 72 is horizontally oriented and fixed in place with respect to the wrench assembly 24 and the latch member 73 is free to slide horizontally in the sleeve 72. The latch member 73 is preferably made of brass or some other suitable bearing material and can be locked in either an extended or retracted position by a removable pin 74. When the latch member 73 is locked in the extended position, as shown on the right hand side of FIG. 2, the latch member 73 holds the actuating member 62 in contact with the bearing element 64. The latch assembly 70 is shown in perspective view in FIG. 2*c* and is designed to accommodate low speed rotation of the actuating member 62 with respect to the latch member 73.

Of course, the detailed construction of the latch assembly can vary widely, depending on the application. The left hand side of FIG. 2 shows an alternate latch member 76 that is actuated by means of a hydraulic cylinder 78.

Also of importance is the threaded annular ring 68 that is welded in place to the underside of the flange 38. As shown in FIG. 2, the tubular T includes a threaded collar C at its upper end. In the event of a threatened blow-out the apparatus 30 can be lowered and rotated to threadedly engage the ring 68 with the collar C, and thereby seal the tubular T. Drilling mud can then be pumped through the passageway 42 to prevent a blow-out.

The left and right hand sides of FIG. 2 show the tubular engaging apparatus 30 in two positions. On the right hand side of FIG. 2, the wrench assembly 24 has been raised with respect to the quill 22 (by operation of the cylinders 28 of FIG. 1). In this position the latch members 73 lift the actuating member 62, which in turn lifts the upper and lower links 58, 56 and the engaging member 50. Because the T-shaped slots 48 of the guides 44 diverge upwardly, this causes the engaging members 50 to move radially outwardly as they move upwardly, thereby disengaging the toothed cylindrical faces 52 from the exterior surface of the tubular T. In the position shown on the right hand side of FIG. 2 the apparatus 30 is disengaged from the tubular T, which can then be inserted into or removed from the apparatus 30.

When it is desired to engage the apparatus 30 with the tubular T, the wrench assembly 24 is lowered with respect to the quill 22 to the position shown on the left hand side of FIG. 2. In this position the wrench assembly 24 presses the actuating member 62 downwardly, thereby moving the engaging members 50 to the lower, converging ends of the T-shaped slots 48. This causes the toothed cylindrical faces 52 to engage the exterior surface of the tubular T for rotation. Once the engaging members 50 have been placed as shown on the left hand side of FIG. 2, the quill 22 can be rotated by the rotating means 20 in order to rotate the apparatus 30 and therefore the tubular T to either make up or break out the lower threaded connection of the tubular T (not shown). Such rotation of the quill 22 causes differential rotation between the actuating member 62 and the wrench assembly 24. This differential rotation is accommodated by the bearing element 64 and the brass latch member 73. As pointed out above, in the event of a threatened blow-out the apparatus 30 can be lowered and rotated to seal the ring 68 against the upper threads of the collar C.

Figure 3:
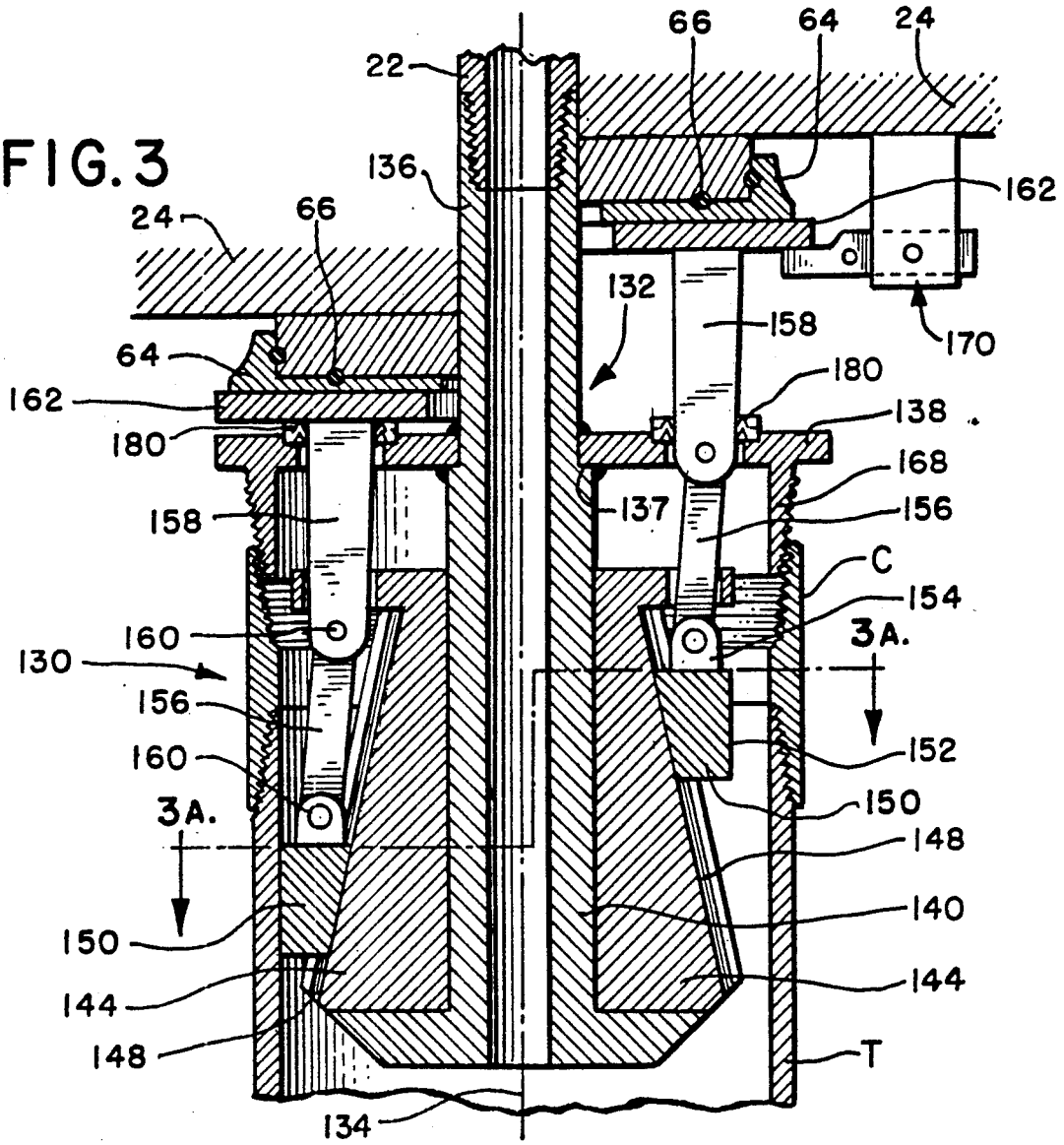
FIG. 3 is a longitudinal sectional view of a second preferred embodiment of the tubular engaging apparatus of this invention.
Figure 3A:
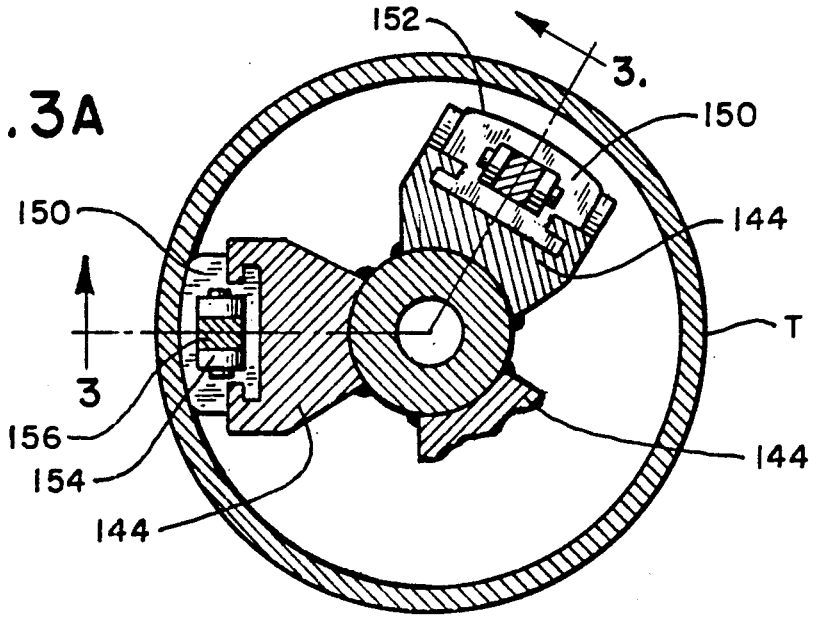
FIG. 3*a* is a cross-sectional view taken along line 3*a*—3*a* of FIG. 3.

This invention is not limited to embodiments that grip the exterior of the tubular T. FIGS. 3 and 3*a* show a second preferred embodiment that is designed to fit into the interior of the tubular T to grip the interior wall. In FIGS. 3 and 3*a* similar reference numerals have been used as in FIGS. 2*a* through 2*c* for similar components, except that 100 has been added. As shown in FIGS. 3 and 3*a*, the tubular engaging apparatus 130 includes a support member 132 that defines a longitudinal axis 134. The support member 132 includes an axial stem 136 that defines an upwardly facing shoulder 137 that supports a horizontal flange 138. The stem 136 also includes a lower portion 140 and defines an axial passageway 142 extending there through. The lower portion in turn supports three symmetrically positioned guides 144 which are rigidly secured to the stem 136. The guides 144 define respective T-shaped slots 148 which converge upwardly. Each of the T-shaped slots 148 mounts a respective engaging member 150 for movement along the slot 148. Each of the engaging members 150 defines a respective toothed cylindrical face 152 shaped to engage the interior of the tubular T. In addition, the engaging members 150 define ears 154 that engage lower links 156 that in turn engage upper links 158. The links 156, 158 and the ears 154 are interconnected by pivots 160, and the upper links 158 are rigidly secured to an annular actuating member 162. The upper links 158 in this embodiment are cylindrical and mirror polished, and the flange 138 mounts seals 180 that provide high pressure sealing against the surface of the upper links 158. An annular threaded ring 168 is mounted to the underside of the flange 138, and is shaped to threadedly engage the upper threads of the collar C. As in the first preferred embodiment, a latch assembly 170 is mounted to the underside of the wrench assembly 24 to release and latch the actuating member 162 against the bearing element 64.

The operation of the second preferred embodiment 130 is similar to that described above. The right hand side of FIG.3 shows the actuating member 162 in the raised or opened position in which the engaging members 150 are raised and shifted radially inwardly by the T-shaped slots 148 to release the tubular T. The left hand side of FIG. 3 shows the actuating member 162 in the lower or closed position in which the downward force supplied by the wrench assembly 24 via the bearing element 64 presses the actuating member 162 and therefore the engaging members 150 downwardly and radially outwardly, into frictional engagement with the interior surface of the tubular T.

As before, in the event of a threatened blow-out the apparatus 130 can be lowered and rotated in order to engage the ring 168 with the collar C and thereby seal the tubular T. In this case the links 158, 160 are positioned within the ring 168 and it is important provide a high pressure seal between the flange 138 and the upper links 158 to prevent leakage past the flange 138.

The preferred embodiments of this invention have been shown mounted to a drilling machine having a top head drive assembly in which make-up/break-out wrenches move axially with respect to the load beam of the top head drive assembly. It is this axial movement of the make-up/break-out wrenches that actuates the tubular engaging apparatus to either engage or release a tubular T. Of course, it is not essential in all embodiments that it be a set of make-up/break-out wrenches that provide the axial movement that controls the tubular engaging apparatus. Rather, any suitable portion of the top head drive assembly that can be caused to move vertically as required can be adapted for this purpose.

Of course, it should be understood that a wide range of changes and modifications can be made to the preferred embodiments described above. For example, three engaging members have been shown, but the number of guides and engaging elements can be varied as desired, as can the shape and configuration of component parts. It is therefore intended that the foregoing detailed description be regarded as illustrative rather than limiting, and that it be understood that it is the following claims, including all equivalents, which are intended to define the scope of this invention.

I claim:

1. An apparatus for engaging a down hole tubular for rotation in a drilling machine of the type comprising a rotatable quill having a threaded lower end, means for rotating the quill, means for vertically positioning the quill, and means for vertically moving an additional element beneath the rotating means with respect to the quill, said apparatus comprising:

a support member defining an axis and having a threaded upper end configured to threadedly engage the threaded lower end of the quill;

a plurality of guides mounted to the support member around the axis and oriented at an angle with respect to the axis;

a plurality of engaging members, each mounted to move in a respective one of the guides to move into engagement with a down hole tubular when positioned toward a first end of the respective guide and to move out of engagement with a down hole tubular when positioned toward a second end of the respective guide said engaging members adapted to transmit torque from the guides to the engaged down hole tubular;

a linkage coupled to the engaging members and comprising an actuating member exposed at an upper portion of the support member and movable along the axis between a closed position, in which the linkage urges the engaging members toward the first ends of the guides, and an open position, in which the linkage urges the engaging members toward the second ends of the guides;

said actuating member shaped and positioned to bear against the additional element such that vertical movement of the additional element with respect to the quill moves the actuating member along the axis and therefore the engaging elements along the guides;

said support member supporting a downwardly facing, threaded, ring shaped member positioned to threadedly engage and seal an upper end portion of the down hole tubular, said down hole tubular dimensioned to be engaged by the engaging members, said ring shaped member axially positioned between the threaded upper end of the support member and the engaging members.

2. The invention of claim 1 wherein the support member comprises an upper tubular element adapted for connection to the quill and wherein the actuating member is positioned around the upper tubular element.

3. The invention of claim 1 wherein the support member comprises a lower tubular element which supports the guides, wherein the lower tubular element is configured to receive an upper portion of a down hole tubular, and wherein the engaging members are positioned to engage an exterior surface of the down hole tubular.

4. The invention of claim 3 wherein the guides converge downwardly and the closed position is positioned vertically beneath the open position.

5. The invention of claim 1 wherein the support member comprises a lower element which supports the guides, wherein the lower element, the guides, and the engaging elements are adapted to fit into a down hole tubular, and wherein the engaging members are positioned to engage an interior surface of the down hole tubular.

6. The invention of claim 5 wherein the guides converge upwardly and the closed position is positioned vertically beneath the open position.

7. The invention of claim 1 wherein the support member defines a central passageway adapted to conduct drilling fluid from the quill into a down hole tubular engaged by the engaging elements.

8. The invention of claim 1 wherein the guides are positioned to surround the down hole tubular and the linkage is positioned radially outwardly from the ring shaped member.

9. The invention of claim 1 wherein the guides are positioned to fit within the down hole tubular, wherein the linkage is positioned radially inwardly of the ring shaped member, and wherein the support member comprises means for providing a sliding seal around the linkage where the linkage passes through the support member.

10. The invention of claim 1 wherein rotating means is included in a top head drive assembly and wherein the additional element is mounted for rotation with respect to the top head drive assembly.

11. The invention of claim 1 wherein the drilling machine further comprises means for releasably latching the actuating member to the additional element.

12. The invention of claim 11 wherein the latching means comprises:

a latch, and means for mounting the latch to the drilling machine for movement between a latching position, in which the latch holds the actuating element to the additional element; and an unlatching position, in which the latch releases the actuating element.

13. An apparatus for engaging a down hole tubular for rotation in a drilling machine of the type comprising a rotatable quill having a threaded lower end, means for rotating the quill, means for vertically positioning the quill, and means for vertically moving an additional element beneath the rotating means with respect to the quill, said apparatus comprising:

a support member defining an axis and having a threaded upper end configured to threadedly engage the threaded lower end of the quill;

a plurality of guides mounted to the support member around the axis and oriented at an angle with respect to the axis;

a plurality of engaging members, each mounted to move in a respective one of the guides to move into engagement with a down hole tubular when positioned toward a first end of the respective guide and to move out of engagement with a down hole tubular when positioned toward a second end of the respective guide, said engaging members adapted to transmit torque from the guides to the engaged down hole tubular;

a linkage coupled to the engaging members and comprising an actuating member exposed at an upper portion of the support member and movable along the axis between a closed position, in which the linkage urges the engaging members toward the first ends of the guides, and an open position, in which the linkage urges the engaging members toward the second ends of the guides;

said actuating member shaped and positioned to bear against the additional element such that vertical movement of the additional element with respect to the quill moves the actuating member along the axis and therfore the engaging elements along the guides;

wherein the guides and engaging members are dimensioned to engage a down hole tubular substantially larger in diameter than the threaded upper end of the support element.

14. An apparatus for engaging a down hole tubular for rotation in a drilling machine of the type comprising a rotatable quill having a threaded lower end, means for rotating the quill, means for vertically positioning the quill, and means for vertically moving an additional element beneath the rotating means with respect to the quill, said apparatus comprising:

a support member defining an axis and having a threaded upper end configured to threadedly engage the threaded lower end of the quill;

a plurality of guides mounted to the support member around the axis and oriented at an angle with respect to the axis;

a plurality of engaging members, each mounted to move in a respective one of the guides to move into engagement with a down hole tubular when positioned toward a first end of the respective guide and to move out of engagement with a down hole tubular when positioned toward a second end of the respective guide, said engaging members adapted to transmit torque from the guides to the engaged down hole tubular;

a linkage coupled to the engaging members and comprising an actuating member exposed at an upper portion of the support member and movable along the axis between a closed position, in which the linkage urges the engaging members toward the first ends of the guides, and an open position, in which the linkage urges the engaging members toward the second ends of the guides;

said actuating member shaped and positioned to bear against the additional element such that vertical movement of the additional element with respect to the quill moves the actuating member along the axis and therefore the engaging elements along the guides;

wherein the guides and engaging members are entirely positioned at a spacing from the axis greater than that of the threaded upper end of the support member.

15. The invention of claim 1 wherein the linkage passes axially alongside the ring shaped member.

* * * * *